US009450316B2

(12) United States Patent
Diop et al.

(10) Patent No.: US 9,450,316 B2
(45) Date of Patent: Sep. 20, 2016

(54) AUTOMATIC CABLE SPLICE

(71) Applicant: Hubbell Incorporated, Shelton, CT (US)

(72) Inventors: Seydou Diop, Birmingham, AL (US); Paul Zelazny, Moody, AL (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/322,002

(22) Filed: Jul. 2, 2014

(65) Prior Publication Data

US 2016/0006139 A1 Jan. 7, 2016

(51) Int. Cl.

| | |
|---|---|
| ***H01R 11/09*** | (2006.01) |
| ***H01R 4/52*** | (2006.01) |
| *H01R 4/50* | (2006.01) |

(52) U.S. Cl.

CPC ..... *H01R 4/52* (2013.01); *H01R 4/5083* (2013.01); *H01R 4/5075* (2013.01); *H01R 11/09* (2013.01)

(58) Field of Classification Search

CPC ..... H01R 13/53; H01R 31/00
USPC ..... 439/796, 723–725, 728, 733.1, 739, 439/794, 787, 799, 795, 786, 792, 788
See application file for complete search history.

(56) References Cited

U.S. PATENT DOCUMENTS

| | | | |
|---|---|---|---|
| 649,542 | A | 5/1900 | Gerard |
| 1,997,649 | A | 4/1935 | Ohlund |
| 2,138,913 | A | 12/1938 | Fotsch |
| 2,144,050 | A | 1/1939 | Fotsch |
| 2,199,283 | A | 4/1940 | Cook |
| 2,215,072 | A | 9/1940 | Rogoff |
| 2,217,978 | A | 10/1940 | Becker |
| 2,463,145 | A | 3/1949 | Buchanan |
| 2,521,722 | A | 9/1950 | Hubbell et al. |
| 2,554,387 | A | 5/1951 | Saul |
| 2,572,940 | A | 10/1951 | Lockhart |
| 2,859,424 | A | 11/1958 | Berndt |
| 2,966,653 | A | 12/1960 | Jugle |
| 3,072,989 | A | 1/1963 | Jugle et al. |
| 3,205,300 | A | 9/1965 | Becker |
| 3,241,204 | A | 3/1966 | Baricevic et al. |
| 3,681,512 | A | 8/1972 | Werner et al. |
| 3,852,850 | A | 12/1974 | Filhaber |
| 4,192,964 | A | 3/1980 | Sacks |
| 4,252,992 | A | 2/1981 | Cherry et al. |
| 4,698,031 | A | 10/1987 | Dawson |
| 5,015,023 | A | 5/1991 | Hall |
| 5,278,353 | A | 1/1994 | Buchholz et al. |

(Continued)

OTHER PUBLICATIONS

U.S. Appl. No. 14/099,052, filed Apr. 23, 2015, Diop et al.

(Continued)

*Primary Examiner* — Phuongchi T Nguyen
(74) *Attorney, Agent, or Firm* — Michael Best & Friedrich, LLP

(57) ABSTRACT

A cable splice includes a casing, a jaw assembly, a biasing member, a guide, and a bullet cup. The casing has an opening and an interior cavity. The jaw assembly is positioned in the interior cavity and moveable between a loading position and a terminated position. The biasing member biases the jaw assembly towards the terminated position. The guide includes a receiving end and a shaft extending at least partially into the interior cavity. The bullet cup is positioned in the jaw assembly in the loading position.

20 Claims, 15 Drawing Sheets

(56) References Cited

U.S. PATENT DOCUMENTS

| | | | | |
|---|---|---|---|---|
| 5,334,056 | A | 8/1994 | Hlinsky | |
| 5,369,849 | A | 12/1994 | De France | |
| 5,445,533 | A | 8/1995 | Roscizewski et al. | |
| 5,600,096 | A | 2/1997 | Cherry et al. | |
| 5,683,273 | A | 11/1997 | Garver et al. | |
| 5,980,284 | A * | 11/1999 | Ho et al. | 439/159 |
| 6,206,736 | B1 | 3/2001 | DeFrance et al. | |
| 6,247,943 | B1 * | 6/2001 | Moga et al. | 439/125 |
| 6,773,311 | B2 | 8/2004 | Mello et al. | |
| 7,219,399 | B2 * | 5/2007 | Tamm et al. | 24/136 R |
| 7,256,348 | B1 | 8/2007 | Endacott | |
| 7,799,996 | B2 | 9/2010 | Tamm et al. | |
| 8,221,155 | B2 | 7/2012 | Luzzi | |
| 8,672,699 | B2 | 3/2014 | Gaertner | |
| 8,674,230 | B2 | 3/2014 | Hoxha | |
| 2006/0108140 | A1 | 5/2006 | Wiley | |
| 2011/0183539 | A1 | 7/2011 | Gaertner | |
| 2012/0217062 | A1 | 8/2012 | Cawood et al. | |
| 2013/0081852 | A1 | 4/2013 | Cawood | |
| 2013/0217250 | A1 | 8/2013 | Melni | |
| 2015/0107875 | A1 * | 4/2015 | Diop et al. | 174/135 |

OTHER PUBLICATIONS

PCT/US2015/038422 International Search Report and Written Opinion dated Oct. 6, 2015.

* cited by examiner

AUTOMATIC CABLE SPLICE

FIELD

The invention relates to splices for splicing together first and second cables.

BACKGROUND

Splicing connectors may be used to join a variety of electrical conductors, including high-voltage power lines. Some splicing connectors allow a user to simply input two different conductors into the connector. Such splicing connectors, commonly referred to as automatic splices, may be used by utility linemen to quickly connect lengths of suspended cables during installation or repair of downed power lines.

An automatic splice typically includes a housing having an opening on each axial end for receiving cables. After the cables are inserted, the housing includes clamps for maintaining the cables in a relative position. The automatic splice is then capable of conducting electricity from one cable to the other. Seating the cables properly in the housing is important to ensure a secure and lasting connection. This seating is especially true in exposed cables undergoing stress from different directions, such as from wind, ice, galloping or additional loading that may occur in regular use.

Utility linemen use automatic splices in normal or emergency power restoration situations, under a variety situations and environmental conditions. Applying significant force to insert the cables or knowing if the cable has been fully inserted may be difficult for the lineman. Automatic splices typically have non-transparent casings or housings, making visual inspection of the cables positioning impossible. If a cable is not properly or fully inserted, the retaining clamps will not function as intended. Failure of a spliced connection can release live cables, risking dangerous conditions to people and property, especially in the instance of live power lines.

SUMMARY

A cable splice includes a casing, a jaw assembly, a biasing member, a guide, and a bullet cup. The casing has an opening and an interior cavity. The jaw assembly is positioned in the interior cavity and moveable between a loading position and a terminated position. The biasing member biases the jaw assembly towards the terminated position. The guide includes a receiving end and a shaft extending at least partially into the interior cavity. The bullet cup extends at least partially into the guide and is positioned in the jaw assembly in the loading position.

A cable splice includes a casing, a jaw assembly, a biasing member, a guide, and a bullet cup. The casing has an opening and an interior cavity. The jaw assembly is positioned in the interior cavity and moveable between a loading position and a terminated position. The biasing member biases the jaw assembly towards the terminated position. The guide includes a receiving end and a shaft extending at least partially into the interior cavity. The bullet cup is positioned in the jaw assembly in the loading position and has a first chamber with a first diameter and a second chamber with a second diameter less than the first diameter.

A cable splice includes a casing, a jaw assembly, a biasing member, a guide, and a bullet cup. The casing has an outer surface, a first set of dimples formed on the outer surface, an opening, and an interior cavity. The jaw assembly is positioned in the interior cavity and moveable between a loading position and a terminated position. The biasing member biases said jaw assembly towards the terminated position. The guide includes a receiving end and a shaft extending at least partially into the interior cavity and centered in the interior cavity by the first set of dimples. The bullet cup is positioned in the jaw assembly in the loading position.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
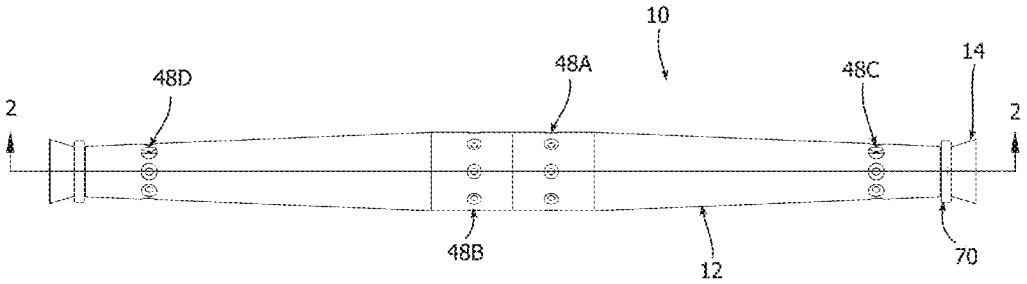
FIG. 1 is a front elevational view of a cable splice according to an exemplary embodiment.

In accordance with an exemplary embodiment, an automatic splice 10 includes a casing 12, a guide 14, a bullet cup 16, a clamp in the form of a jaw assembly 18, a biasing member 20, and a center stop 22. The casing 12 includes a substantially tubular body having a first casing end 26 and a second casing end 28 tapering from a cylindrical central region 30, and having an internal cavity 32. The internal cavity may also be divided into a tapered first chamber 34, a tapered second chamber 36, and a cylindrical central chamber 38. One guide 14, bullet cup 16, and jaw assembly 18 are positioned in each of the first and second chambers 34, 36. The center stop 22 is positioned in the central chamber 38 and a pair of biasing members 20 extends from first and second sides of the central chamber 38, respectively.

Figure 2:
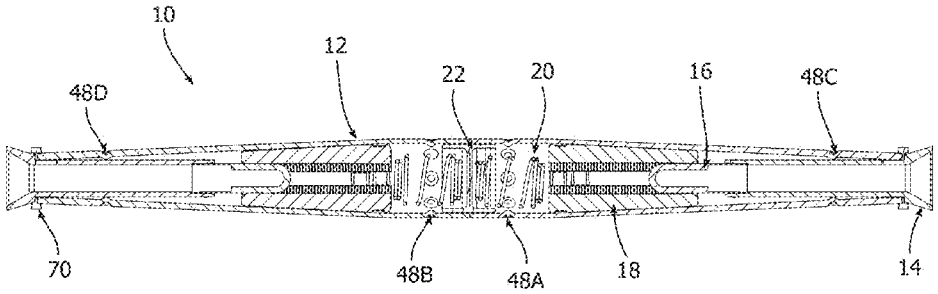
FIG. 2 is a front sectional view of the cable splice of FIG. 1 taken along line 2-2.

As shown in FIG. 2, the components in the second chamber 36 may be identical to the first. Certain embodiments, however, may utilize different components in the second chamber 36. The present invention may also be utilized as a dead-end type connector that has only a single chamber as discussed in further detail with respect to FIG. 36. Although the drawings depict the first and second chambers 34, 36 having identical components, only the components of the first chamber 34 may be discussed in certain instances for brevity.

Figure 3:
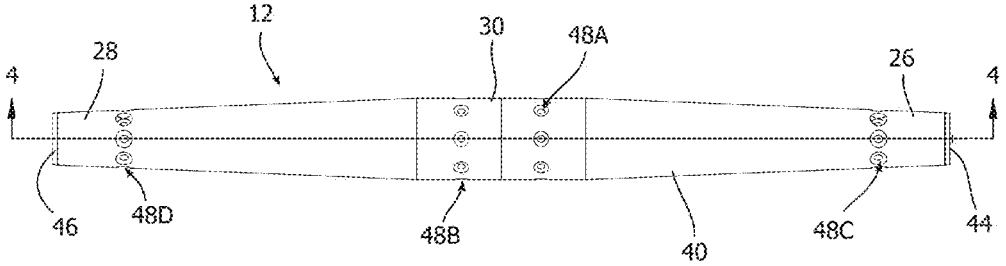
FIG. 3 is a bottom plan view of the casing of FIG. 1.
Figure 4:
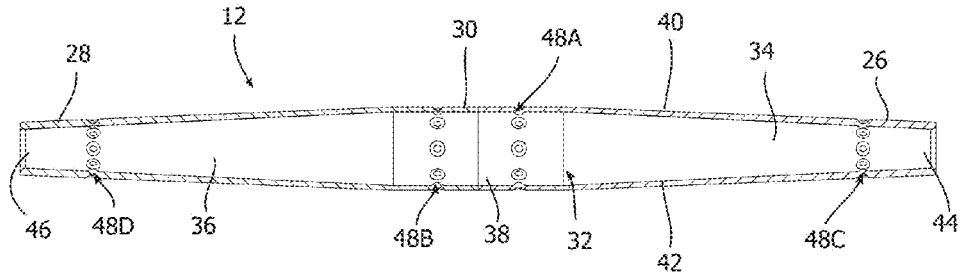
FIG. 4 is a bottom plan view in section of the casing of FIG. 3 taken along line 4-4.
Figure 5:
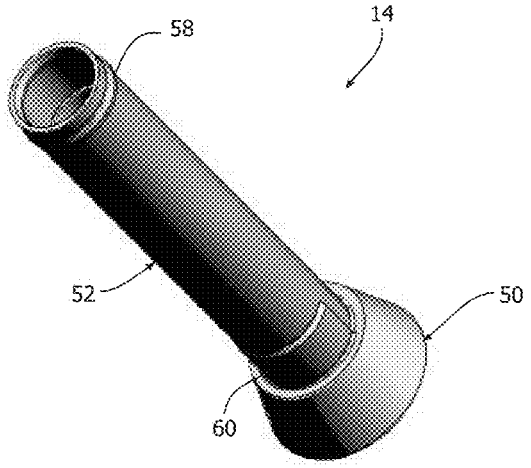
FIG. 5 is a perspective view of the guide of the exemplary cable splice of FIG. 2.
Figure 6:
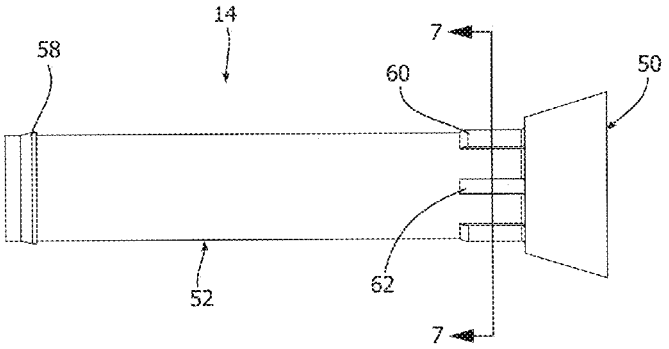
FIG. 6 is a front elevational view of the guide of FIG. 5.
Figure 7:
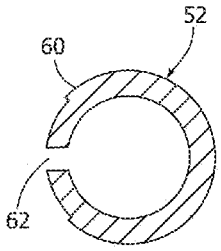
FIG. 7 is a right side view in section of the guide of FIG. 6 taken along line 7-7.
Figure 8:
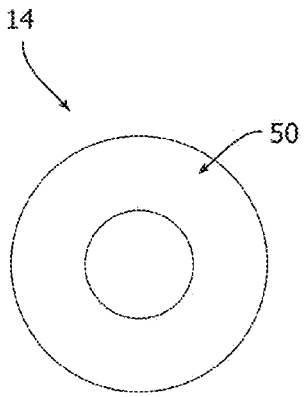
FIG. 8 is a right side elevational view of the guide of FIG. 5.
Figure 9:
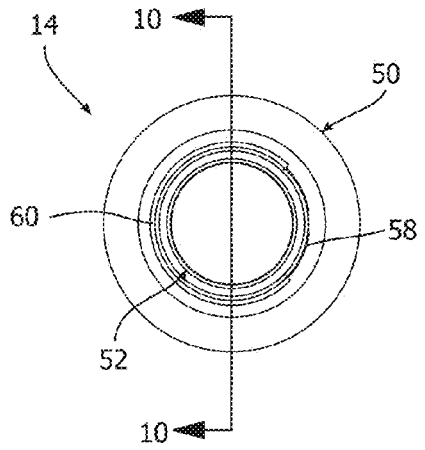
FIG. 9 is a left side elevational view of the guide of FIG. 5.
Figure 10:
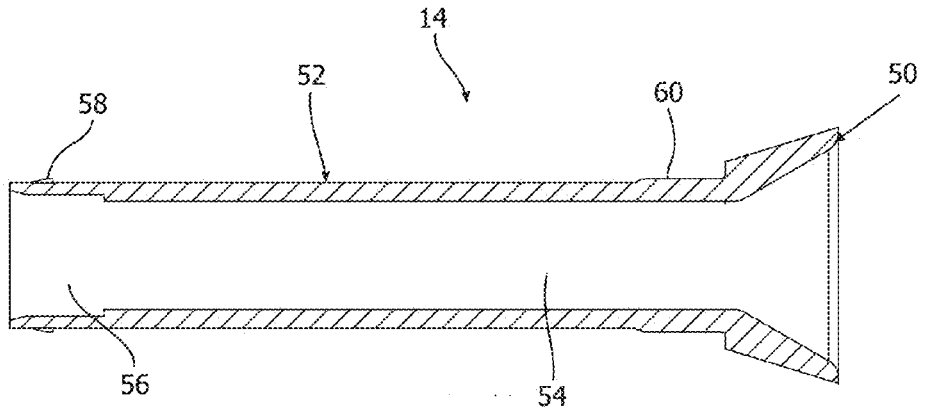
FIG. 10 is front view in section of the guide of FIG. 9 taken along line 10-10.
Figure 11:
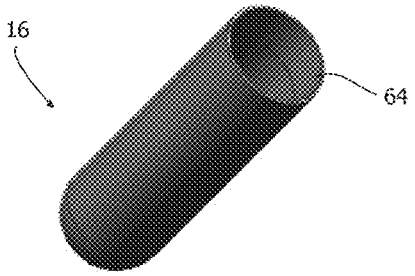
FIG. 11 is a perspective view of the bullet cup of the cable splice of FIG. 2.
Figure 12:
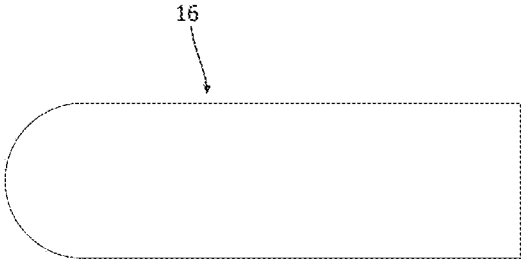
FIG. 12 is a front elevational view of the bullet cup of FIG. 11.
Figure 13:
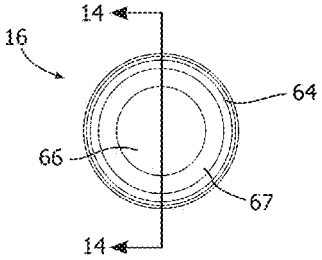
FIG. 13 is a right side elevational view of the bullet cup of FIG. 11.
Figure 14:
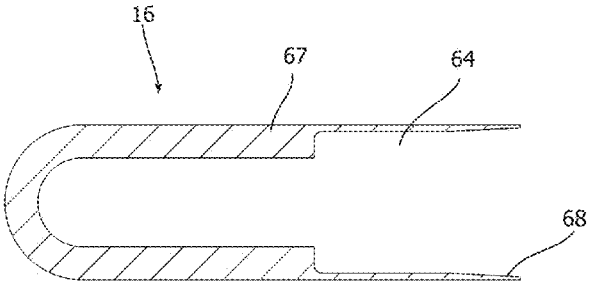
FIG. 14 is a front view in section of the bullet cup of FIG. 13 taken along lines 14-14.

As best shown in FIGS. 3-4, the exemplary casing 12 includes the tubular body 24, although a variety of shapes may be used having any number of straight or curved sides. The casing 12 includes an outer casing surface 40, an inner casing surface 42, a first casing aperture 44 and a second casing aperture 46. The first and second casing apertures 44, 46 may include a chamfered or beveled edge to allow for easy installation of additional components, for example, the guide 14 and bullet cup 16. In this exemplary embodiment, the first casing end 26 tapers from the central region 30 to the first casing aperture 44, forming a frusto-conical member.

In various exemplary embodiments, the casing 12 includes one or more sets of dimples 48. For example, the central region 30 includes a first set of dimples 48A and a second set of dimples 48B, and the first and second casing ends 26, 28 include a third and fourth set of dimples 48C, 48D, respectively. The first and second sets of dimples 48A, 48B retain the center stop 22. The third set of dimples 48C helps to maintain the guide 14 centered in the casing 12 and concentric with the bullet cup 16. The third set of dimples 48C may directly contact the guide 14 in a centered position or they may be spaced from the guide 14 and positioned to contact the guide 14 if it becomes off-center.

As best shown in FIGS. 5-10, and according to an exemplary embodiment, the guide 14 extends into the casing 12 through the first casing aperture 44. The guide 14 receives and guides a cable being inserted into the automatic splice 10. The guide 14 helps prevent strands of the cable from splaying, allowing a quick, easy, and clean insertion of a length of cable.

The guide 14 includes a receiving end 50 having a funnel-shaped body surrounding an aperture and a cylindrical shaft 52 extending from the receiving end 50. The receiving end 50 is positioned outside of the casing 12, while the shaft 52 extends into the first chamber 34. In alternative exemplary embodiments, the receiving end 50 and the shaft 52 are positioned either partly or entirely, in the first chamber 34. The receiving end 50 may be a variety of shapes and sizes, depending on relevant factors such as the cable shape and size. The guide 14 may arcuately transition between the receiving end 48 and the shaft 50.

The shaft 52 has a first inner surface defining a first section 54 with a first diameter and a second inner surface defining a second section 56 with a second diameter. The diameter of the first section 54 is less than the diameter of the second section 56. The shaft has a substantially constant outer diameter with a stop 58 and a flange 60. The stop 58 is a projection extending partially or continuously around the shaft 52. For example, the stop 58 need not entirely encircle the shaft 52, and may include a single projection of a determined length or arc, as well as multiple discrete projections. The stop 58 may have different shapes and sizes, including various arcuate and planar surfaces. In the exemplary embodiment shown, the stop 58 has a right-trapezoidal shape in transverse cross-section, with a front stop surface and an angled rear wall. This allows the stop 58 to easily pass along the inner casing surface 42 during insertion of the guide 14 into the casing 12, but assists in preventing the guide 14 from subsequently exiting the casing 12. The stop 58 may impede the withdrawal of the guide 14 from the casing 12 by friction engagement with the tapered inner casing surface 42 at a certain point, or the inner casing surface 42 may be provided with a corresponding projection or tab to engage the stop 58.

The flange 60 extends partially around the shaft 52 to have a substantially C-shaped cross section. In various exemplary embodiments, the flange 60 may be broken up into sections to form ribs. A slot 62 extends into the shaft 52 and is positioned between the ends of the first flange 58. The slot 62 may extend partially into the shaft 52 or entirely through the shaft 52. The flange 60 and slot 62 allow the guide 14 to be placed into casings 12 having different inner diameters. The flange 60 engages the inner casing surface 42 providing a secure fit between the casing 12 and the guide 14, assisting in retaining the guide 14 in position and preventing unwanted movement relative to the casing 12. The slot 62 allows for a certain amount of compression of the shaft 52, allowing the guide 14 to fit into casings 12 having smaller inner diameters.

As best shown in FIGS. 11-14, and according to an exemplary embodiment, the automatic splice 10 includes a bullet cup 16 that is positioned in the first chamber 34 behind the guide 14. The bullet cup 16 is initially positioned in the jaw assembly 18 to hold the jaw assembly 18 open, and can be either connected to, adjacent to, or spaced laterally from the guide 14. After a cable is inserted into and passes through the guide 14, it enters the bullet cup 16 to travel through the jaw assembly 18.

According to the exemplary embodiment, the bullet cup 16 has a cylindrical outer surface with an open first end and a semi-spherical, closed second end, although a variety of shapes, sizes, and configurations may be used. The bullet cup 16 has a first inner surface surrounding a first chamber 64 with a first diameter proximate to the first end and a second inner surface surrounding a second chamber 66 with a second diameter proximate to the second end. The diameter of the first chamber 64 is greater than the diameter of the second chamber 66, resulting in the bullet cup 16 having a thicker, inner rear wall 67. When the bullet cup 16 is positioned in the jaw assembly 18, the thicker rear wall 67 provides additional support against the force exerted by the jaw assembly 18 on the bullet cup 16, helping to prevent the bullet cup 16 from becoming crushed, deformed, or dislodged. The inner surface surrounding the first chamber 64 has a tapered portion 68, tapering towards the open first end of the bullet cup 16.

Figure 15:
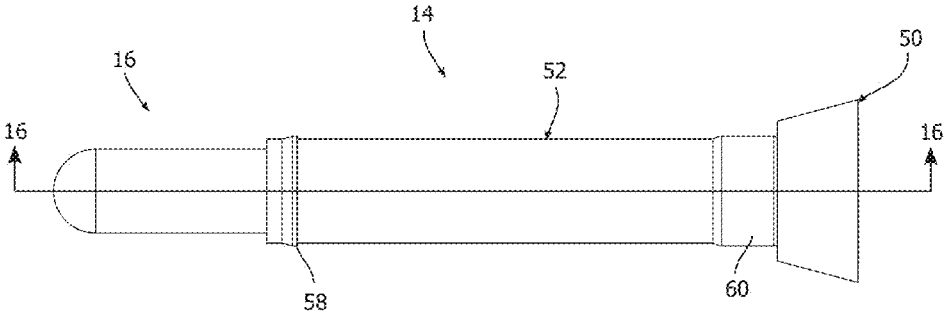
FIG. 15 is a front elevational view of the connected guide and bullet cup of the cable splice of FIG. 2.
Figure 16:
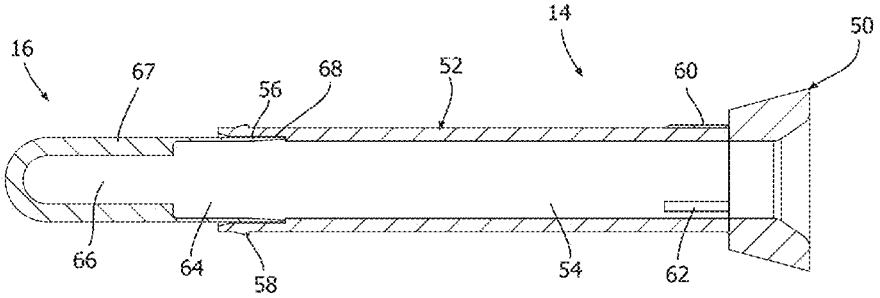
FIG. 16 is a bottom plan view in section of the connected guide and bullet cup of FIG. 15 taken along line 16-16.

As best shown in FIGS. 15 and 16, and according to an exemplary embodiment, the bullet cup 16 is connected to the guide 14 with the second chamber 56 of the guide 14 receiving the first end of the bullet cup 16. The tapered portion 68 of the bullet cup 16 extends into the guide 14 adjacent the guide 14 first chamber 54, and the end of the tapered portion 68 is substantially flush with or less than the diameter of the guide 14 first chamber 54. The tapered portion 68 allows an inserted cable to be smoothly transitioned between the guide 14 and the bullet cup 16.

Optionally, an identification ring 70 may be included on the automatic splice 10 positioned adjacent the receiving end 48 of the guide 14. The identification ring 70 may be integral with the guide 14 or it may be a separate component that is attached to the guide 14, for example, by sliding the identification ring 70 over the shaft 52. In various exemplary embodiments, the identification ring 70 may use markings or be colored as well as pattern coded to identify the size and type of cables or conductors that are spliced together. For example, if different sized cables are spliced together, the identification rings 70 on either end of the casing may have a different color.

Figure 17:
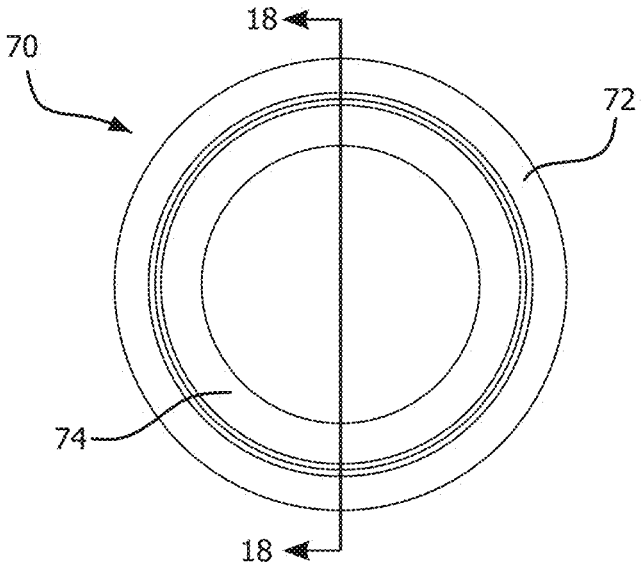
FIG. 17 is a right side elevational view of the ID ring of the cable splice of FIG. 1.
Figure 18:
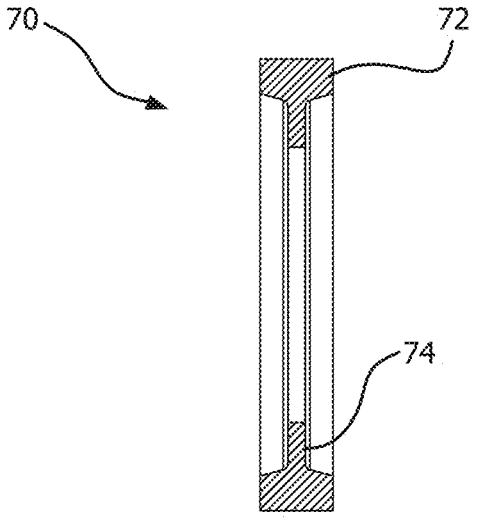
FIG. 18 is a front view in section of the ID ring of FIG. 17 taken along line 18-18.

As best shown in FIGS. 17 and 18, and according to an exemplary embodiment, the identification ring 70 includes an outer ring 72 and a connected or integral inner ring 74. The outer ring 72 has a diameter and thickness greater than the inner ring 74. This allows the identification ring 70 to securely nest with the receiving end 50 of the guide 14 on one side and the casing 12 on the opposite side.

Figure 19:
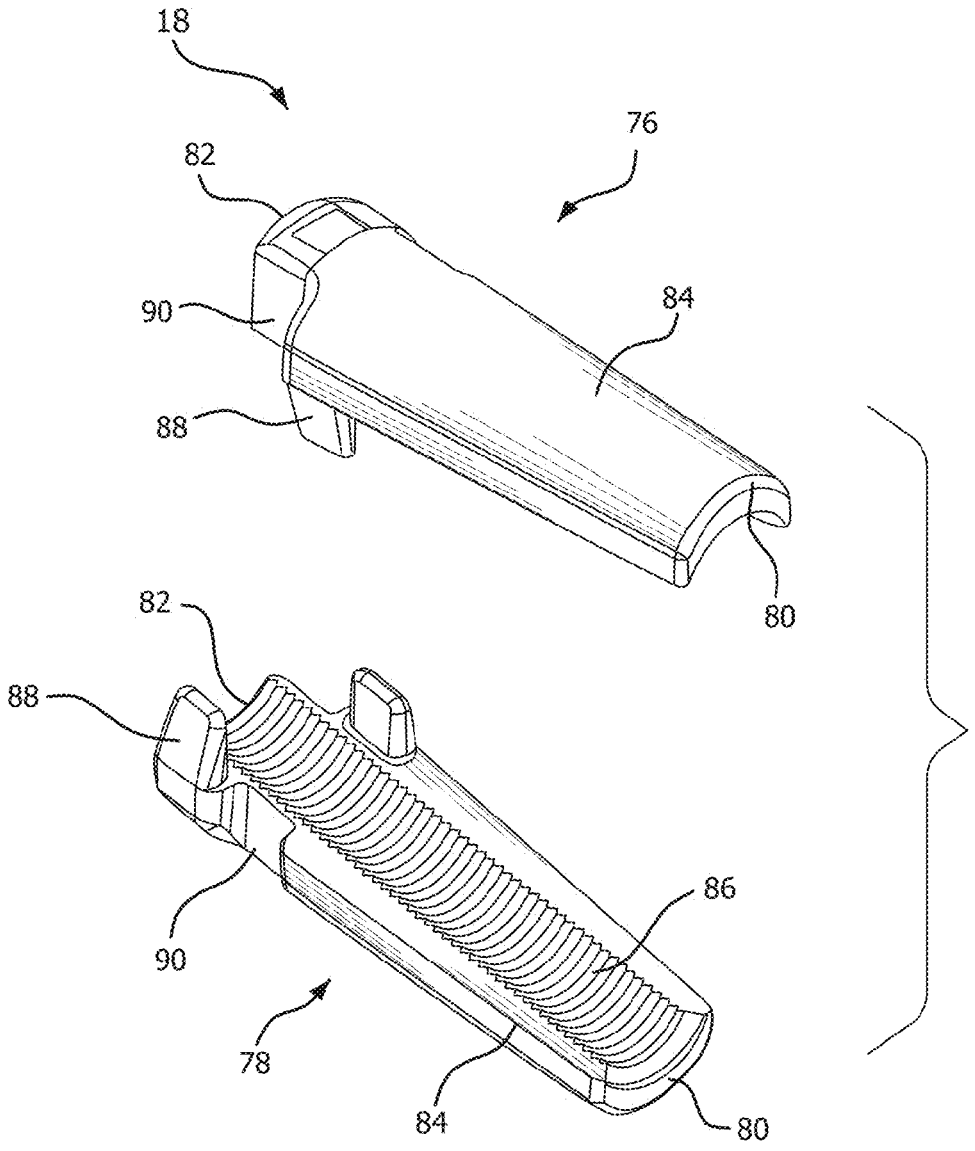
FIG. 19 is an exploded perspective view of the jaw assembly of the cable splice of FIG. 2.
Figure 20:
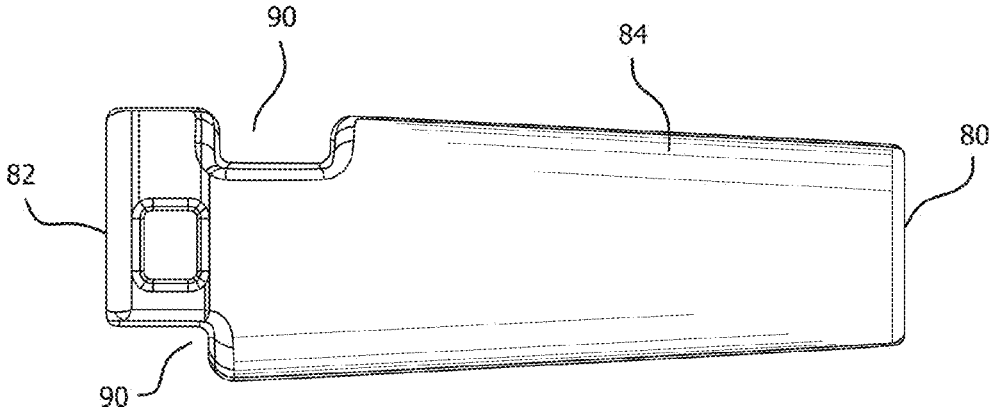
FIG. 20 is a top plan view of a jaw member of FIG. 19.
Figure 21:
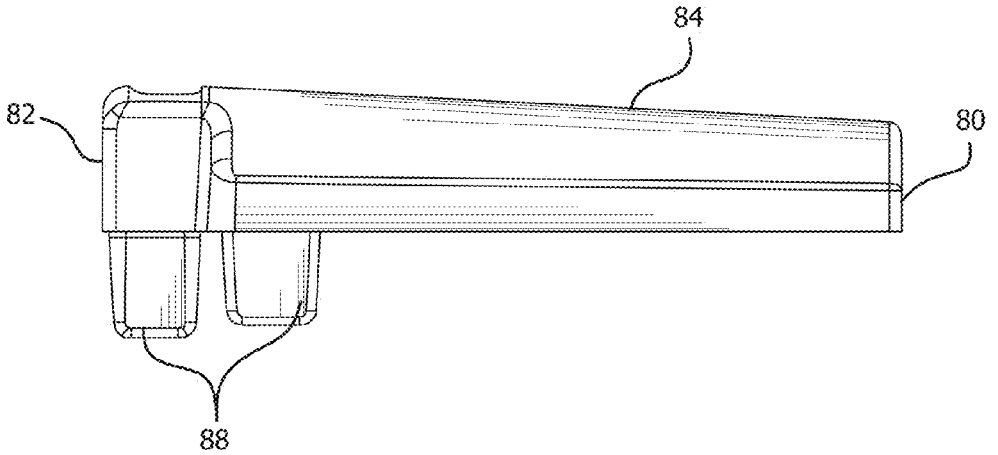
FIG. 21 is a front elevational view of a jaw member of FIG. 19.

The jaw assembly 18 is positioned between the guide 14 and the biasing member 20. As best shown in FIGS. 19-21, the jaw assembly 18 includes an upper jaw member 76 and a lower jaw member 78. Though two jaw members 76, 78 are shown in this exemplary embodiment, one jaw member or more than two jaw members may also be used. Certain embodiments may utilize other cable retainers, instead of, or in combination with, the jaw members 76, 78, as would be understood by one of ordinary skill in the art.

The upper jaw member 76 and the lower jaw member 78 are substantially identical as shown in FIG. 19, and the same references numbers will be used for like parts in describing the jaw members 76, 78. The jaw members 76, 78 have a front jaw surface 80, a rear jaw surface 82, and a jaw body 84 extending therebetween. The jaw body 84 has an arcuate outer surface and an inner surface. At least a portion of the jaw body 84 has a semi-funnel-shape, tapering towards the front jaw surface 80. This taper is similar to or corresponds to the taper of the inner casing surface 42, allowing the jaw members 76, 78 to slide within the first chamber 34. At least a portion of the jaw body 84 inner surface contains a series of teeth 86. The teeth 86 may have any shape, pitch, length, width, or spacing. In the exemplary embodiment, the teeth 86 extend from the inner surface at an angle towards the rear jaw surface 82.

The jaw members 76, 78 include one or more radially extending projections 88 and one or more corresponding openings 90. The projections 88 and openings 90 may have a variety of sizes or shapes. The projections 88 and openings 90 are staggered, so that a single part may be used for the upper jaw member 76 and the lower jaw member 78. When placed together, the projections 88 from the upper jaw member 76 will mate with the openings 90 of the lower jaw member 78 and vice versa. This mating relationship couples the upper jaw member 76 to the lower jaw member 78 to prevent one jaw member from moving axially relative to the other jaw, ensuring substantially uniform axial movement between the jaw members 76, 78. The projections 88 extend radially inwardly and have a length preventing disengagement as the jaw members 76, 78 are moved radially away from one another by being pushed towards the central region 30, but also prevents the projections 88 from interfering with movement of the jaw members 76, 78 as they are biased towards the first casing end 26 by extending through the openings 90 and contacting the inner casing surface 42.

Figure 22:
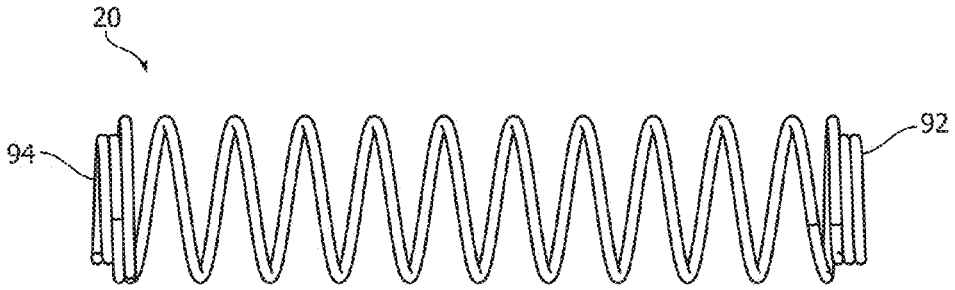
FIG. 22 is a front elevational view of a biasing member of the cable splice of FIG. 2.
Figure 23:
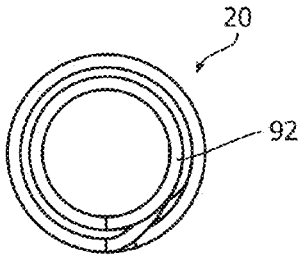
FIG. 23 is a right side elevational view of the biasing member of FIG. 22.

As best shown in FIGS. 22 and 23, and according to an exemplary embodiment, the biasing member 20 has a first end 92 for contacting the rear jaw surface 82 and a second end 94 for contacting the center stop 22. In the exemplary embodiment shown, the biasing member 20 is a coil spring, although the biasing member 20 may other devices or materials. The outer diameter, wire diameter, pitch, length and material type of the spring may be varied depending on the application.

The first and second ends 92, 94 of the exemplary biasing member 20 have two or more coils that are approximately in contact. The end coils therefore have a pitch approximately equal to half the thickness of the coils. In an exemplary embodiment, the first two coils and at least half a turn of the second coil are approximately in contact with one another. The coils on the first and second ends 92, 94 have a first outer diameter. The center portion of the biasing member has a number of coils with a second outer diameter that is greater than the first outer diameter. This configuration increases the stiffness of the spring. In various exemplary embodiments, the length, outer diameter, number of coils, and configuration of the spring may vary depending on the required force.

Figure 24:
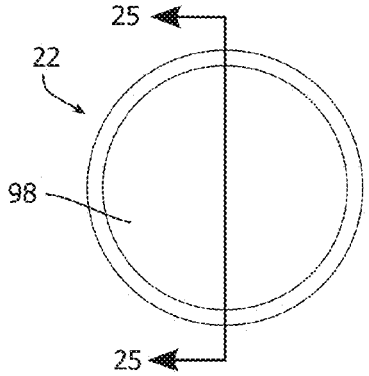
FIG. 24 is a right side elevational view of the center stop of the automatic cable splice of FIG. 2.
Figure 25:
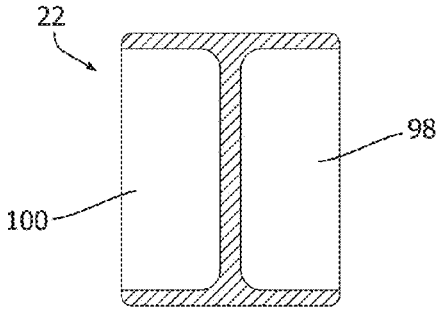
FIG. 25 is a front view in section of the center stop of FIG. 24 taken along line 25-25.

As best shown in FIGS. 24 and 25, and according to an exemplary embodiment, the center stop 22 has a center wall 96, a first opening 98, and a second opening 100. The first opening 98 receives the second end 94 of the biasing member 20 and at least partially encloses a portion of the biasing member 20. The partial enclosure helps maintain the biasing member 20 in place, preventing it from becoming dislodged and failing to exert proper biasing force in the correct direction. According to various exemplary embodiments, the center stop 22 is substantially cylindrical having corresponding cylindrical first and second openings 98, 100, although any shape, or combination of shapes, of center stop 22 and first and second openings 98, 100 may be used. The center stop 22 is held in position in the central chamber 38 by the first and second set of dimples 48A, 48B.

As best shown in FIGS. 1 and 2, in the initial position, the guide 14 extends into the first chamber 34. The first end of the bullet cup 16 is positioned in the guide 14 and the second end is positioned in the jaw assembly 18. The guide 14 receiving end 50 extends at least partially outside of the casing 12. The identification ring 70 is also positioned outside of the casing 12. The bullet cup 16 is clamped in the jaw assembly 18, for example between the upper and lower jaw members 76, 78. The position of the bullet cup 16 prevents the upper jaw member 76 and the lower jaw member 78 from moving closer together and prevents them from moving towards the first casing aperture 44, holding the jaw assembly 18 open to receive a cable. In this position, the guide 14 and bullet cup 16 cause the jaw assembly 18 to compress the biasing member 20 in a loading position.

With the automatic splice 10 in the initial, or loading, position, a first cable C1 and a second cable C2 may be loaded into respective ends of the casing 12. Certain cables may utilize multiple strands that can spread or divert as the end of the cable is introduced into the casing 12. The guide 14 receiving end 50 acts to contain the strands of the cables C1, C2 and guide them into and through the respective first and second casing apertures 44, 46.

After passing into the guide 14 a certain distance, the cable C1 engages the bullet cup 16. In various exemplary embodiments the bullet cup 16 is connected to the guide as shown in FIG. 2, although in other alternative embodiments the bullet cup 16 may be held in the jaw assembly spaced from the guide 14. The cable C1 enters the first chamber 64 of the bullet cup 16 and abuts the second chamber 66. In certain instances, the cable C1, or strands of the cable C1, may enter the second chamber 66 of the bullet cup 16 depending on the size and the condition of the cable C1. The position of the bullet cup 16 partially inside of the guide 14 helps prevent the bullet cup 16 from coming dislodged from its proper, initial position. For example, the bullet cup 16 may become dislodged during storage of the automatic splice 10 and during shipment or transfer to a job site. As mentioned above, automatic splices 10 may be used in harsh environmental conditions including severe storms that may result in the bullet cup 16 dislodging during handling of the automatic splice 10 at the job site. Moreover, even though the strands of the cable C1 are retained in the guide 14, they may still have a tendency to splay. Splayed ends of the cable C1 can dislodge or misalign an unconnected bullet cup 16 as the cable C1 is inserted through the guide 14, although certain exemplary embodiments may utilize such a spaced orientation. With the bullet cup 16 positioned in the guide 14, these problems are avoided.

After the cable C1 fully engages the bullet cup 16, the exertion of axial pressure by a user pushes the bullet cup 16 and the cable C1 through the jaw assembly 18. Because the bullet cup 16 is already positioned in the jaw assembly 18, the user need not exert substantial force to open the jaw assembly 18 or load the biasing member 20. Moreover, the clamping of the bullet cup 16 and its initial position in the jaw assembly 18 secures the bullet cup 16 such that it will not dislodge and rotate or tumble as it is traveling through the jaw assembly 18, preventing an early termination of the jaw assembly 18 before the cable C1 is fully inserted. The connected bullet cup 16 and initial position in the jaw assembly 18 also prevent any splayed ends of the cable C1 from interfering with the jaw assembly 18 or the biasing member 20 that would adversely affect the connection made by the automatic splice 10.

Figure 26:
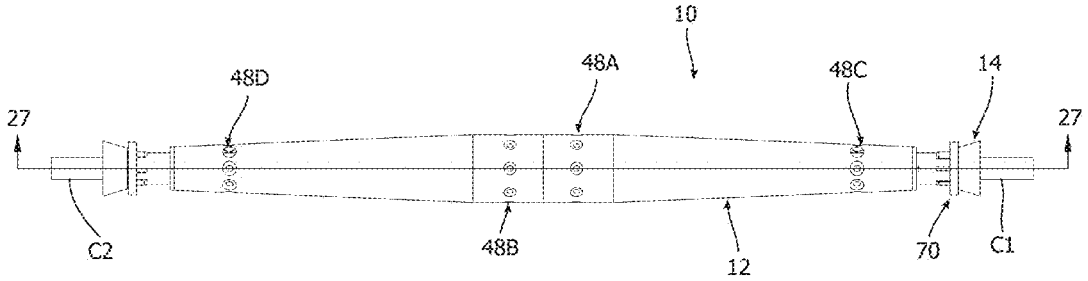
FIG. 26 is a front elevational view of the cable splice of FIG. 1 with first and second cables inserted.
Figure 27:
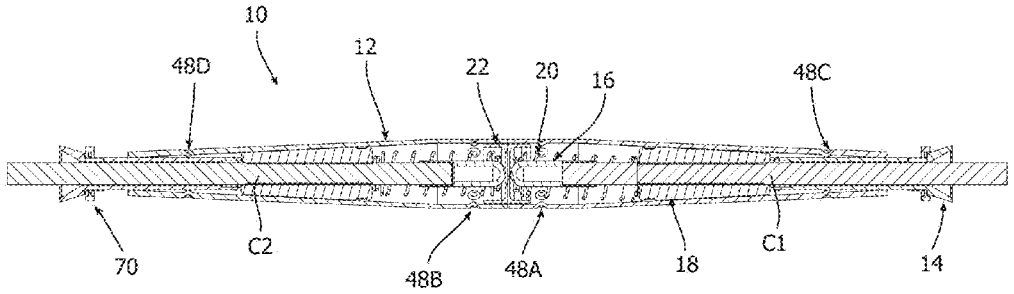
FIG. 27 is a bottom plan view in section of the cable splice of FIG. 26 taken along line 27-27.

As best shown in FIGS. 26 and 27, after the bullet cup 16 passes entirely through the jaw assembly 18, the upper and lower jaws 76, 78 are released and the biasing member 20 moves the upper and lower jaws 76, 78 toward the first casing aperture 44. As the jaw assembly 18 moves forward, the tapered jaw body 84 slides along the tapered inner casing surface 42, forcing the upper jaw 76 and the lower jaw 78 radially closer to one another. The jaw assembly 18 reaches a terminal position where it is securely clamped onto the cable C1, resisting the cable C1 from being pulled out or dislodged. The terminal position is not a set point and may vary based on the automatic splice 10, the jaw assembly 18, or the cable C1. As the jaw assembly 18 clamps to the cable C1, the teeth 86 engage the cable C1, assisting to prevent the cable's C1 removal from the splice 10. In various exemplary embodiments, the biasing member 20 disengages the jaw assembly 18 at a certain point, allowing the tension force from the conductor C1 to retain the jaw assembly 18 in the terminal position. In other embodiments, the biasing member 20 continues to engage and bias the jaw assembly 18 when it is in the terminal position.

According to various exemplary embodiments, as the jaw assembly 18 moves forward, it will urge at least a portion of the guide 14 out of the casing 12. Movement of the guide 14 out of the casing 12 can indicate that the cable C1 has been properly terminated, and a user can be sure of a secure connection. The guide 14 may be provided with various indicia, such as markings or colors on the shaft 52 to make it easier for a user to tell that the cable C1 has been secured or to indicate how far the jaw assembly 18 has traveled.

Figure 28:
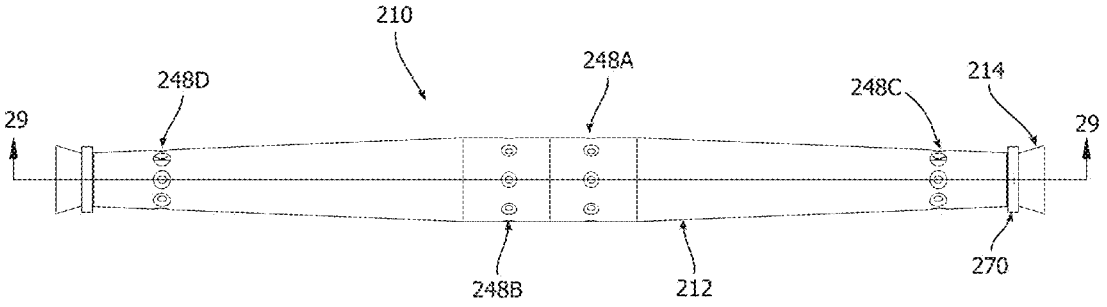
FIG. 28 is a front elevational view of a cable splice according to a second exemplary embodiment.
Figure 29:
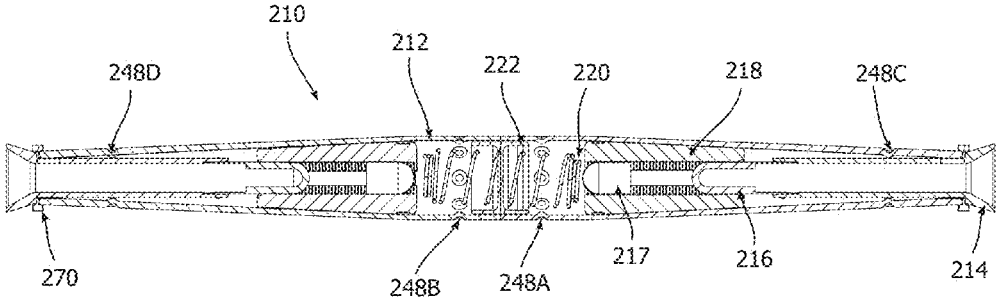
FIG. 29 is a bottom plan view in section of the cable splice of FIG. 28 taken along line 29-29.

FIGS. 28 and 29 depict another exemplary embodiment of an automatic splice 210 including a casing 212, a guide 214, a bullet cup 216, a pilot cup 217, a clamp in the form of a jaw assembly 218, a biasing member 220, and a center stop 222. The pilot cup 217 is initially positioned in the jaw assembly 218 between the bullet cup 216 and the center stop 222. In various exemplary embodiments, the bullet cup 216 extends into the guide 214, or it may be spaced from the guide 214. The automatic splice may also use a second pilot cup 217 in place of the bullet cup 216.

Figure 30:
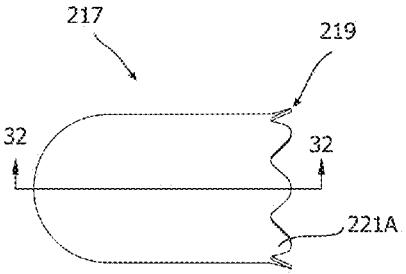
FIG. 30 is a front elevational view of the pilot cup of the cable splice of FIG. 28.
Figure 31:
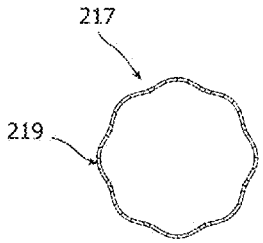
FIG. 31 is a right side elevational view of the pilot cup of FIG. 30.
Figure 32:
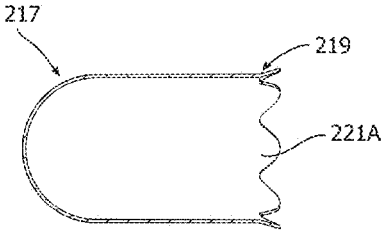
FIG. 32 is a bottom plan view in section of the pilot cup of FIG. 30 taken along line 32-32.
Figure 33:
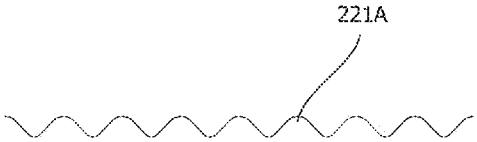
FIG. 33 is a flat plan view of the flared edge of the pilot cup of FIG. 30.
Figure 34:
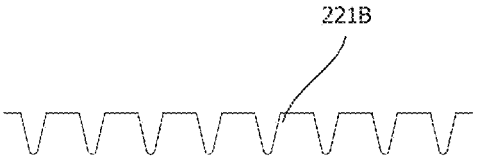
FIG. 34 is a flat plan view of an alternative configuration of the flared edge of the pilot cup of FIG. 30.

The pilot cup 217 is initially positioned in the jaw assembly 18 to stabilize and provide extra support, helping to prevent misalignment or preactivation of the jaw assembly 18. As best shown in the exemplary embodiment of FIGS. 30-32, the pilot cup 217 has a cylindrical outer surface with an open first end and a semi-spherical, closed second end, although a variety of shapes, sizes, and configurations may be used. The open end is surrounded by a flared edge 219 having a set of projections and grooves extending outwardly from cylindrical outer surface and upwardly away from the center axis. In various exemplary embodiments, the flared edge 219 may be a wave-like edge including a set of curved projections 221A as shown in FIG. 33, a crenellated edge having a set of teeth 221B, as shown in FIG. 34, or another suitable design.

Figure 35:
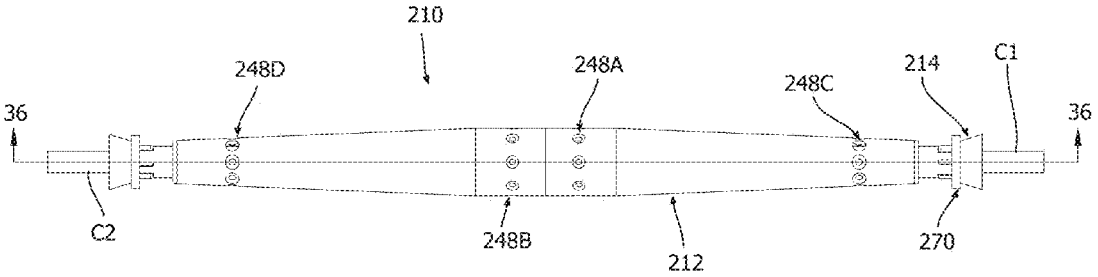
FIG. 35 is a front elevational view of the cable splice of FIG. 28 with first and second cables inserted.
Figure 36:
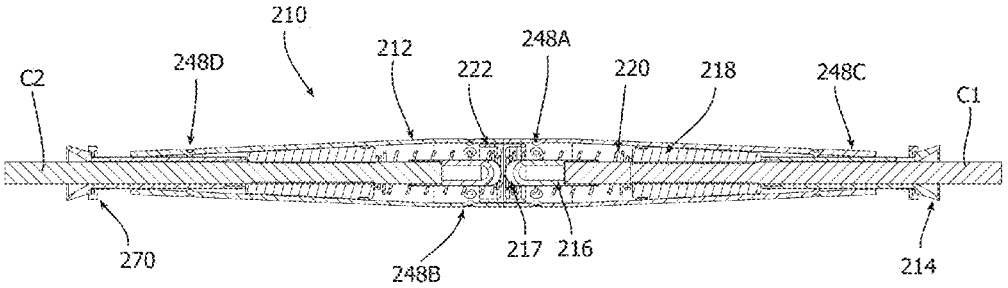
FIG. 36 is a bottom plan view in section of the automatic cable splice of FIG. 35 taken along line 36-36.

FIGS. 35 and 36 show the exemplary cable splice having a pair of cables C1, C2 inserted into respective ends of the casing 212. The cables C1, C2 are inserted into the guide 214 and engage the bullet cup 216. Further insertion moves the bullet cup 216 away from the guide 214 and through the jaw assembly 218. As the bullet cup 216 moves through the jaw assembly 218, it enters into the pilot cup 217 and displaces the pilot cup 217 towards the center stop 222. The flared edge 219 helps initially retain the pilot cup 217 in the jaw assembly 218 and eases the insertion of the bullet cup 216 into the pilot cup 217.

Figure 37:
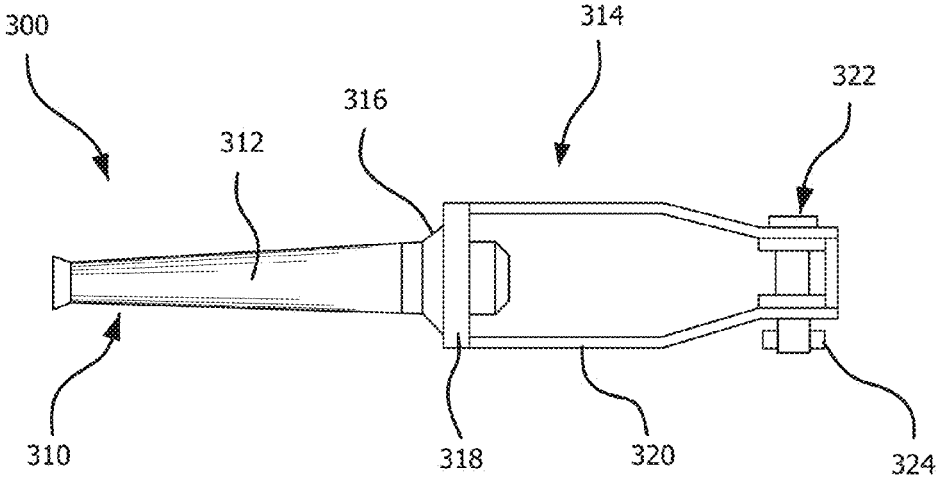
FIG. 37 is a side elevational view of a cable slide with a dead-end connector according to an exemplary embodiment of the invention.

As best shown in FIG. 37, the configuration of the automatic splices 10, 210 may also be used in an automatic dead-end connector 300. The automatic dead-end connector 300 includes half of an automatic splice 310 having a casing 312. Although not shown, the automatic splice 310 can include any combination of the internal components of the automatic splices 10, 210 discussed herein. The casing 312 is attached to a dead end connector 314. In this exemplary embodiment a clevis-type dead end connector is used, although other types of connectors may be used as would be understood by one of ordinary skill in the art. The dead end connector 314 includes a retaining washer 316, a yoke 318, and a bail 320. A clevis pin 322 is secured to the bail 320 and retained by a cotter pin 324.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A cable splice, comprising:

a casing having an opening and an interior cavity;

a jaw assembly positioned in said interior cavity and moveable between a loading position and a terminated position;

a biasing member biasing said jaw assembly towards the terminated position;

a guide having a receiving end and a shaft extending at least partially into said interior cavity, the shaft having a first section with a first diameter and a second section with a second diameter greater than the first diameter; and a bullet cup simultaneously extending at least partially into said second section of said guide and positioned in said jaw assembly in the loading position.

2. The cable splice of claim 1, wherein said biasing member comprises a spring having a first coil and second coil with a pitch of approximately half the coil thickness.

3. The cable splice of claim 1, wherein said casing comprises a set of dimples positioned to center said guide in said casing.

4. The cable splice of claim 1, further comprising a pilot cup positioned in said jaw assembly in the loading position distally of said bullet cup with respect to said opening.

5. The cable splice of claim 1, wherein said casing comprises an inner surface tapering toward said opening at one end thereof and defining said interior cavity, said jaw assembly comprises jaw members tapering toward ends thereof facing said opening, being movable toward said opening and radially toward one another in a direction of the terminated position, being movable away from said opening and away from one another in a direction of the loading position and being restrained against axial movement relative to one another, and said bullet cup being located between said jaw members to maintain said jaw members in the loading position by preventing radial inward movement thereof, and being movable completely through said jaw members by a cable being forced therein to allow movement of said jaw members to the terminated position.

6. The cable splice of claim 1, wherein said bullet cup comprises a first chamber and a second chamber.

7. The cable splice of claim 6, wherein said bullet cup is removable from said guide and moveable past said jaw assembly to allow said jaw assembly to transition from the loading position to the terminated position.

8. A cable splice comprising:

a casing having an opening and an interior cavity;

a jaw assembly positioned in said interior cavity and moveable between a loading position and a terminated position;

a biasing member biasing said jaw assembly towards the terminated position;

a guide having a receiving end and a shaft extending at least partially into said interior cavity, the shaft having a first section with a first diameter and a second section with a second diameter greater than the first diameter; and a bullet cup simultaneously extending at least partially into said second section of said guide and positioned in said jaw assembly in the loading position, the bullet cup having a first chamber with a first diameter and a second chamber with a second diameter less than said first diameter.

9. The cable splice of claim 8, wherein said casing comprises a frusto-conical portion tapering to said opening having a first set of dimples and a cylindrical region having a second set of dimples.

10. The cable splice of claim 8, wherein said bullet cup comprises a wall having a first thickness surrounding said first chamber and a second thickness greater than said first thickness surrounding said second chamber.

11. The cable splice of claim 8, wherein said bullet cup comprises an inner surface surrounding said first chamber having a tapered portion.

12. The cable splice of claim 8, wherein during movement of said jaw assembly from the loading position to the terminated position, said jaw assembly contacts said guide causing at least a portion of said shaft to exit said interior cavity.

13. The cable splice of claim 8, wherein said guide includes a flange and a slot allowing the guide to fit in casings having different sized interior cavities.

14. The cable splice of claim 8, wherein said casing comprises an inner surface tapering toward said opening at one end thereof and defining said interior, said jaw assembly comprises jaw members tapering toward ends thereof facing said opening, being movable toward said opening and radially toward one another in a direction of the terminated position, being moveable away from said opening and away from one another in a direction of the loading position and being restrained against axial movement relative to one another, and said bullet cup being movable completely through said jaw members by a cable being forced therein to allow movement of said jaw members to the terminated position.

15. The cable splice of claim 14, further comprising a pilot cup positioned between said jaw members in the loading position distal to said bullet cup with respect to said opening.

16. The cable splice of claim 15, wherein said pilot cup is sized to receive bullet cup.

17. The cable splice of claim 15, wherein said pilot cup comprises a flared end.

18. A cable splice comprising:

a casing having an outer surface, a first set of dimples formed on the outer surface, an opening, and an interior cavity;

a jaw assembly positioned in said interior cavity and moveable between a loading position and a terminated position;

a biasing member biasing said jaw assembly towards the terminated position;

a guide having a receiving end and a shaft extending at least partially into said interior cavity and centered in said interior cavity by said first set of dimples, the shaft having a first section with a first diameter and a second section with a second diameter greater than the first diameter; and a bullet cup simultaneously extending at least partially into said second section of said guide and positioned in said jaw assembly in the loading position.

19. The cable splice of claim 18, further comprising a center stop positioned in said interior cavity.

20. The cable splice of claim 19, wherein said casing comprises a second set of dimples and a third set of dimples and said center stop is positioned between said second and third set of dimples.

* * * * *